US010738514B2

(12) United States Patent
Hickman

(10) Patent No.: US 10,738,514 B2
(45) **Date of Patent: *Aug. 11, 2020**

(54) ANTI-FRICTION LATCHBOLT

(71) Applicant: dormakaba USA Inc., Indianapolis, IN (US)

(72) Inventor: Chad A. Hickman, Rensselaer, IN (US)

(73) Assignee: dormakaba USA Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/225,846

(22) Filed: Dec. 19, 2018

(65) Prior Publication Data

US 2019/0383067 A1 Dec. 19, 2019

Related U.S. Application Data

(63) Continuation of application No. 14/433,161, filed as application No. PCT/US2013/063407 on Oct. 4, 2013, now Pat. No. 10,196,843.

(60) Provisional application No. 61/710,261, filed on Oct. 5, 2012.

(51) Int. Cl.

| | |
|---|---|
| ***E05C 1/02*** | (2006.01) |
| ***E05C 1/08*** | (2006.01) |
| ***E05B 15/10*** | (2006.01) |
| ***E05B 17/00*** | (2006.01) |

(52) U.S. Cl.

CPC ..... *E05C 1/02* (2013.01); *E05B 15/102* (2013.01); *E05B 17/007* (2013.01); *E05C 1/085* (2013.01); *Y10T 292/096* (2015.04)

(58) Field of Classification Search

CPC ..... Y10T 70/5226; Y10T 292/564; Y10T 292/1037; Y10T 292/558; Y10T 292/0803; Y10T 292/0886; E05B 63/044; E05B 15/102; E05B 17/007; E05B 47/0607; E05B 63/14

See application file for complete search history.

(56) References Cited

U.S. PATENT DOCUMENTS

| | | | | | |
|---|---|---|---|---|---|
| 3,235,298 | A * | 2/1966 | Check | E05B 59/00 | 292/5 |
| 3,319,986 | A * | 5/1967 | Balducci | E05B 63/20 | 292/92 |
| 3,359,027 | A * | 12/1967 | Schlage | E05B 59/00 | 292/222 |
| 3,371,947 | A * | 3/1968 | Gridley | E05B 63/127 | 292/144 |
| 3,397,002 | A * | 8/1968 | Russell | E05B 57/00 | 292/192 |
| 3,477,755 | A * | 11/1969 | Nolin | E05B 59/00 | 292/229 |

(Continued)

*Primary Examiner* — Mark A Williams

(74) *Attorney, Agent, or Firm* — Faegre Drinker Biddle & Reath LLP

(57) ABSTRACT

A latchbolt assembly includes a solid latchbolt having at least a first surface, a second surface and a third surface and an anti-friction bolt pivotally coupled to the solid latchbolt. The anti-friction bolt includes a cross member disposed adjacent the first surface of the solid latchbolt and a pair of plates depending from the cross member to form a U-shaped cross section. The plates are disposed adjacent the second and third surfaces of the solid latchbolt.

4 Claims, 4 Drawing Sheets

(56) References Cited

U.S. PATENT DOCUMENTS

| | | | | | |
|---|---|---|---|---|---|
| 3,492,038 | A * | 1/1970 | Fu | E05B 63/127 | 292/78 |
| 3,583,740 | A * | 6/1971 | Armstrong | E05B 63/20 | 292/198 |
| 3,586,361 | A * | 6/1971 | Ohno | E05C 19/163 | 292/169 |
| 3,767,239 | A * | 10/1973 | Horgan, Jr. | E05B 65/1013 | 292/66 |
| 5,927,770 | A * | 7/1999 | Huang | E05B 15/102 | 292/169.14 |
| 7,201,409 | B2 * | 4/2007 | Adachi | E05B 17/0041 | 292/101 |
| 8,292,336 | B2 * | 10/2012 | Moon | E05B 55/00 | 292/143 |

* cited by examiner

ANTI-FRICTION LATCHBOLT

The present invention relates to latchbolts in general and anti-friction latchbolts in particular.

CROSS-REFERENCE TO RELATED APPLICATION

The present application is a continuation of U.S. Non-Provisional patent application Ser. No. 14/433,161, filed Apr. 2, 2015, which was the National Stage of International Application No. PCT/US2013/063407, filed Oct. 4, 2013, which claims the benefit of U.S. Provisional Application No. 61/710,261, filed Oct. 5, 2012, the entire disclosures of which are hereby expressly incorporated herein by reference.

BACKGROUND OF THE INVENTION

Various means have been used to reduce friction on latches. One reason for this effort is to minimize wear on the latch. Another reason is to minimize the likelihood that a door will not fully close, thereby leaving a room susceptible to unauthorized access.

Past efforts illustrated in FIG. 1 typically include a latchbolt having a first portion 10 with two fingers 12 extending longitudinally from a base portion 14 forming a yoke and a second portion 16 pivotally mounted between the two fingers 12. Such latchbolts are typically installed in mortise boxes having a front plate through which the latchbolt extends to engage a strike installed in the doorjamb.

The second portion 16 includes a shoulder 18 extending therefrom in the direction of the closing action of the door. As the door closes, the second portion 16 engages the strike and is thereby pivoted between the two fingers 12. As the second portion 16 pivots, the shoulder 18 engages the inner surface of the front plate, thereby beginning the retraction of the latchbolt into the mortise box before the two fingers 12 engage the strike.

Past efforts have proven to be weak and lacking in durability. The present invention overcomes these disadvantages by providing an outside anti-friction bolt that is stronger and more durable than conventional anti-friction bolts.

SUMMARY OF THE INVENTION

A latchbolt assembly includes a solid latchbolt having at least a first surface, a second surface and a third surface and an anti-friction bolt pivotally coupled to the solid latchbolt. The anti-friction bolt includes a cross member disposed adjacent the first surface of the solid latchbolt and a pair of plates depending from the cross member. The plates are disposed adjacent the second and third surfaces of the solid latchbolt. In preferred embodiments, the latchbolt includes a curved camming surface and the cross member is configured to cooperate with the curved camming surface to assist retraction of the latchbolt into a mortise box. In other embodiments, the anti-friction bolt has a U-shaped cross section, wherein the anti-friction bolt is pivotally coupled to the solid latchbolt.

In still other embodiments, a latchbolt assembly includes a rod, a solid latchbolt coupled to the rod, and an anti-friction bolt pivotally coupled to the solid latchbolt. The anti-friction bolt includes a cross member and a pair of plates depending orthogonally from the cross member, with the cross member and plates cooperating to form a U-shaped cross-section. The anti friction bolt is disposed to straddle the solid latchbolt on three sides.

DETAILED DESCRIPTION OF THE DRAWINGS

Figure 10:
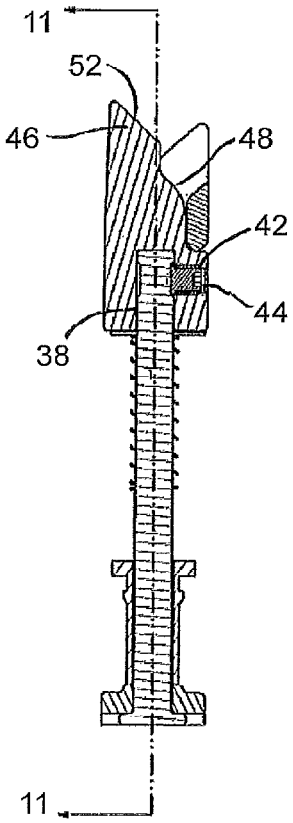
FIG. 10 is a section view taken along lines 10-10 of FIG. 11.
Figure 11:
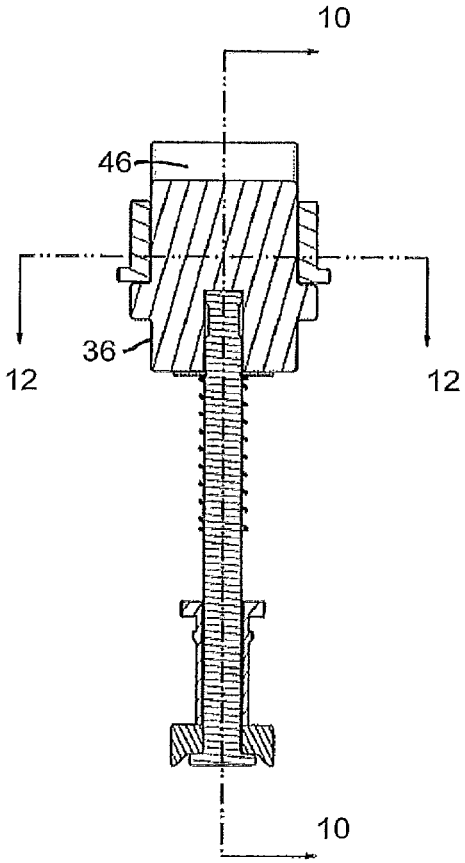
FIG. 11 is a section view taken along lines 11-11 of FIG. 10.

An exemplary latchbolt assembly 20 is shown in FIGS. 2 and 10-12. The latchbolt assembly 20 includes a tailpiece 22, a rod 24, a bushing 26, a spring 28, a solid one piece latchbolt 32, and an anti-friction bolt 34. The tailpiece 22, rod 24, bushing 26 and spring 28 are assembled into a rod assembly 30 and coupled to the solid one piece latchbolt 32 as illustrated in FIGS. 10-11.

Figure 1:
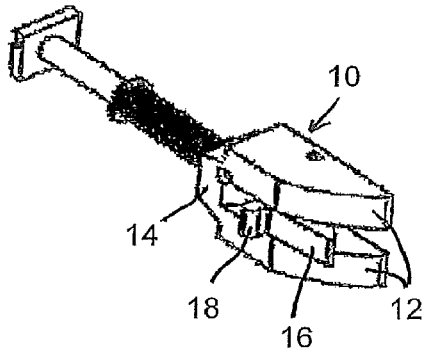
Figure 1 PRIOR ART
FIG. 1 illustrates a prior art latchbolt.
Figure 2:
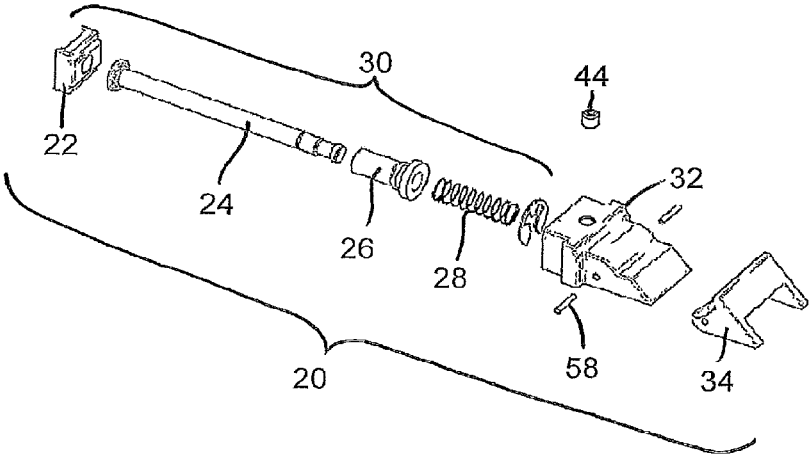
FIG. 2 is an exploded view of an exemplary latchbolt according to the present invention.
Figure 3:
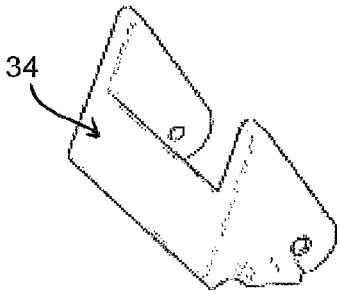
FIGS. 3-9 are views of an exemplary anti-friction bolt for use with the latchbolt of FIG. 2.
Figure 4:
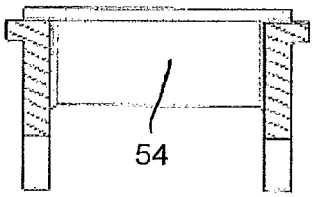
Figure 5:
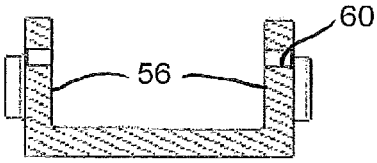
Figure 6:
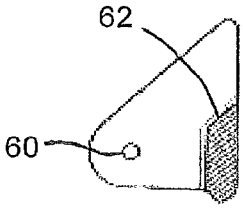
Figure 7:
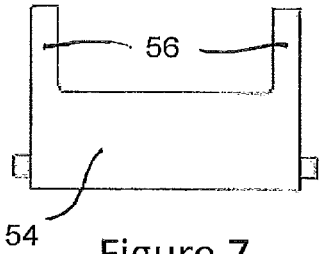
Figure 8:
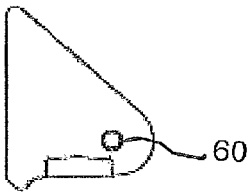
Figure 9:
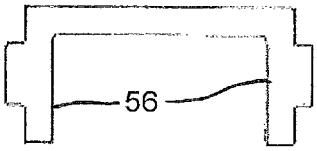
Figure 12:
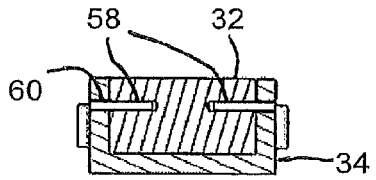
FIG. 12 is a section view taken along lines 12-12 of FIG. 11.

The anti-friction bolt 34 as illustrated in FIGS. 3-9 has a generally U-shaped cross section. It includes a cross member 54 and a pair of plates 56 depending orthogonally therefrom. The plates 56 include pivot pin apertures 60 for receiving pivot pins 58 as illustrated in FIG. 12. The cross member 54 includes a beveled edge 62

The solid one piece latchbolt 32 includes a base portion 36 having a rod assembly-receiving bore 38 and a retaining screw bore 42. The rod assembly 30 is operatively disposed in the rod assembly-receiving bore 38 and a retaining screw 44 is operatively disposed in the retaining screw bore 42 to engage the rod assembly 30, thereby retaining the rod assembly 30 in the base portion 36. The solid one piece latchbolt 32 further includes a strike-engaging portion 46 that includes a curved camming surface 48 and a beveled camming surface 52.

The orthogonal plates 56 of the anti-friction bolt 34 extend parallel to and adjacent to the solid one piece latchbolt 32 as illustrated in FIGS. 11-12. The plates 56 are pivotally coupled to the solid one piece latchbolt 32 by pivot pins 58. 'Thus, the anti-friction bolt 34 is configured to straddle the solid latchbolt 32 on three sides as illustrated in FIG. 12. When pivotally coupled to the solid latchbolt 32, the cross member 54 is configured to engage the curved camming surface 48 of the solid one piece latchbolt 32.

Figure 13:
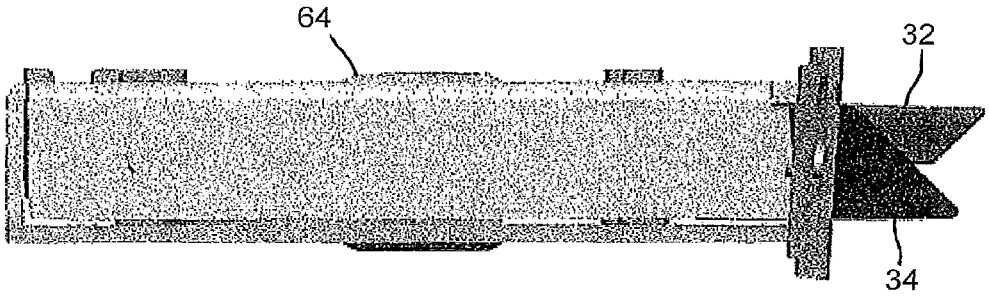
FIG. 13 is a top view of a mortise box with the exemplary latchbolt of FIG. 2 disposed therein with the latchbolt in the fully extended configuration.
Figure 14:
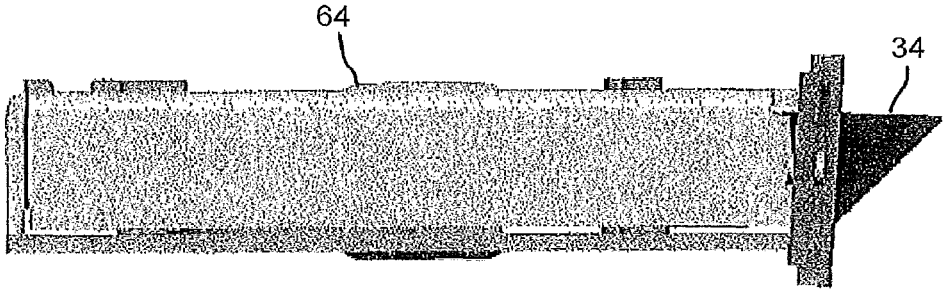
FIG. 14 is a top view of a mortise box with the exemplary latchbolt of FIG. 2 disposed therein with the latchbolt in the partially retracted configuration.

In operation, the latchbolt assembly 20 is conventionally installed in a mortise box 64 as illustrated in FIGS. 13-14. The mortise box 64 is installed in a door edge and positioned to align the latchbolt assembly 20 with a strike formed in a doorjamb in a known manner. As the door is closed, the strike engages the leading edges of the orthogonal plates 56, causing the anti-friction bolt 34 to pivot about the pivot pins 58. As the anti-friction bolt 34 pivots, the cross member 54 of anti-friction bolt 34 engages the curved camming surface 48 of the solid latchbolt 32, cooperating with the strike and the pivot pins 58 to partially force the latchbolt assembly 20 into the mortise box 64. The anti-friction bolt 34 continues to pivot about the pivot pins 58 until the leading edges of the orthogonal plates 56 align with the beveled camming surface 52 of the solid latchbolt 32. Once the leading edges and solid latchbolt 32 are aligned, the strike cams against the solid latchbolt 32 and the anti-friction bolt 34 to continue retracting the latchbolt assembly 20 into the mortise box 64.

While a number of exemplary aspects have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A latchbolt assembly comprising:

a solid latchbolt having at least a first surface, a second surface and a third surface;

a pivot pin; and an anti-friction bolt pivotally coupled to the solid latchbolt through the pivot pin, the anti-friction bolt including a cross member disposed adjacent the first surface of the solid latchbolt and a pair of plates depending from the cross member, the plates being disposed adjacent the second and third surfaces of the solid latchbolt, the anti-friction bolt being pivotally coupled to the solid latchbolt through the pivot pin via the plates;

wherein the first surface of the solid latchbolt is an exterior curved camming surface spaced apart from the pivot pin, and the cross member is configured to cooperate with the curved camming surface to assist retraction of the solid latchbolt when both the solid latch bolt and anti-friction bolt engage a strike.

2. A latchbolt assembly comprising:

a rod;

a solid latchbolt coupled to the rod, the solid latchbolt haying a first exterior side to a first side of the rod and a second exterior side to a second side of the rod, opposite the first side, the second exterior side being parallel to and opposite the first exterior side; and an anti-friction bolt having a U-shaped cross section, the anti-friction bolt being pivotally coupled to the solid latchbolt at a first end of the U-shaped cross section positioned proximate the first exterior side and at a second end of the U-shaped cross section positioned proximate the second exterior side, wherein the anti-friction bolt is positioned and configured to cooperate with the latchbolt to assist retraction of the solid latchbolt when both the solid latch bolt and anti-friction bolt engage a strike.

3. A latchbolt assembly comprising:

a rod having a longitudinal axis;

a solid latchbolt coupled to the rod, the solid latchbolt having a first side, a second side opposite and non-intersecting with the first side, and an exterior camming surface extending between the first side the second side, the exterior camming surface intersecting the longitudinal axis of the rod; and an anti-friction bolt pivotally moveably coupled to the solid latchbolt in only a single degree of freedom, wherein the anti-friction bolt is positioned and configured to assist retraction of the solid latchbolt via the exterior camming surface cooperating with the anti-friction bolt when both the solid latch bolt and anti-friction bolt engage a strike.

4. The latchbolt assembly of claim 3, further comprising a tailpiece having an open interior, the rod being received in the open interior of the tailpiece;

a bushing carried by the rod and positioned between the solid latchbolt and the tailpiece; and a spring carried by the rod and positioned between the solid latchbolt and the bushing, wherein the anti-friction bolt is pivotable relative to the solid latchbolt.

* * * * *